United States Patent [19]

Purdy

[11] Patent Number: 4,844,280

[45] Date of Patent: Jul. 4, 1989

[54] CONTAINER WITH REINFORCED CORNER STRUCTURE

[75] Inventor: Richard L. Purdy, West Bayshore, N.Y.

[73] Assignee: Metricase Corporation, Bohemia, N.Y.

[21] Appl. No.: 82,851

[22] Filed: Aug. 6, 1987

[51] Int. Cl.[4] ..... B65D 45/00

[52] U.S. Cl. ..... 220/71; 220/62

[58] Field of Search ..... 220/71, 73, 77, 67, 220/1.5, 62

[56] References Cited

U.S. PATENT DOCUMENTS

| | | | |
|---|---|---|---|
| 261,753 | 7/1882 | Patterson | 190/24 |
| 2,006,673 | 7/1935 | Crawford | 224/45 |
| 2,216,147 | 10/1940 | Ward | 220/73 X |
| 2,673,657 | 3/1954 | Bergh et al. | 220/71 X |
| 2,849,142 | 8/1958 | Riccio | 217/65 |
| 2,980,285 | 4/1961 | Parsons | 220/84 |
| 3,025,995 | 3/1962 | Koelsch et al. | 220/71 |
| 3,035,735 | 5/1962 | Presnick | 220/62 |
| 3,061,133 | 10/1962 | Reynolds | 220/1.5 |
| 3,236,404 | 2/1966 | Boscamp | 220/62 X |
| 3,553,823 | 1/1971 | Alfredsson | 29/471.1 |
| 3,999,679 | 12/1976 | Kalous | 220/62 X |
| 4,023,726 | 5/1977 | Massac | 228/184 |
| 4,521,941 | 6/1985 | Gerhard | 24/287 |

*Primary Examiner*—Steven M. Pollard

*Attorney, Agent, or Firm*—Dilworth & Barrese

[57] ABSTRACT

The corners of a transit case which has been erected from a flat metal blank are reinforced with closure caps which serve to seal off case corner openings which are left in the case incident its erection from a sheet blank.

10 Claims, 4 Drawing Sheets

CONTAINER WITH REINFORCED CORNER STRUCTURE

BACKGROUND OF THE INVENTION

The present invention relates to improvements in cases such as transit containers, and refers more particularly to an improved container fabricated from a flat metal blank and provided with a reinforced corner construction which significantly enhances resistance to fracture of the formed container structure in the corner regions thereof.

Specialized forms of transit cases are used for many purposes. One class of such cases is designed for use in transport and storage of electronic devices, instruments and other materials and devices that easily could be rendered unsuited for intended purposes if housed in inadequate case structures during transportation and handling. By reason of such usage, these cases are designed to be of rugged construction to prevent damage to the case and the devices and goods contained therein. In some applications or usages, these cases must be designed to withstand the testing effects of a free fall and repeated droppings from heights of up to five feet onto a concrete surface. Following the drop testing the cases are inspected to determine if they have retained watertight integrity. If not, they are rejected for use. It is particularly important, therefore, that such cases have high strength character at the corners thereof inasmuch as careless handling, e.g., dropping of the case in use (and which are the conditions duplicated in testing) can result in high shock force transmission to the structure which under such circumstances impacts at the corners more often than at the planar sides. It also is desirable that these cases be of lightweight material construction and that they be fabricated in manners as involves reasonable manufacturing costs.

One method for fabricating cases involves deep drawing an aluminum blank to shape it into a case half which can be used or connected by hinges or otherwise with a like case half to form a case enclosure. While this is a procedure suited to form a structure of, e.g., integral bottom and four side walls, it presents certain disadvantages. For one thing, the drawing operation can produce undesirable varying wall or skin thickness as well as abrasion in the structure reducing the inherent strength thereof. These structures, therefore, do not stand up too well in many drop testing procedures. Also a sharp draw shaping is usually limited to a container wall height of about 10 to 12 inches maximum. Another drawback is that it is more expensive and burdensome to have to perform certain fabrication operations such as punching and shaping the structure walls for reception of appurtenant accessories like hinges, handles etc. than it is to do so on a flat metal blank from which such a case structure can be formed.

In another known method, a case enclosure structure can be formed from a flat metal sheet suitably configured such that by following certain bending steps, the sheet or blank can be erected into a generally rectangularly shaped structure having, e.g., the bottom and four side walls of a case part. In that known method, edges of certain of the wall defining panels of the blank will be welded to others and commonly one wall defining panel will be joined integrally with a perpendicularly disposed adjacent wall defining panel by a convex wall part preferably of parti-hollow cylindrical shape integral with both walls so that there are no sharp dihedral angles where two walls or a wall and the bottom meet. Certain improved case structure characteristics are derived from such arrangement. However, with such case fabrication technique i is not readily possible to form a fully enclosed case corner, i.e., the trihedral defined by the meeting of the three surfaces defined by two adjacent side walls and the bottom. With the described fabrication there is left a small case corner opening which can be, e.g., of T-shape and which must be closed off by filler welding followed by grinding or otherwise dressing that filler material to provide a smooth outside case corner surface. The smoothing or dressing of the curved external surfaces at the corner is a labor intensive procure that it would be advantageous to eliminate. Also, the T-weld is located right at the corner point which is subjected to drop testing and corner impacting in use and is therefore the location where fracture, e.g., separation of container parent material from the weld material, can occur.

Patents which disclose various forms of case corner opening closure and corner reinforcement include U.S. Pat. No. 2,006,673 which discloses use of companion inner and outer metallic corner pieces which sandwich the canvas and waterproof fabric materials of an ice carrier therebetween, the assembly being secured with rivets. U.S. Pat. No. 2,980,285 discloses using a corner block with three arms projecting therefrom and intended to be slid into specially shaped edge rails which receive and hold the case side wall panels. U.S. Pat. No. 2,849,142 relates to a wooden box construction in which longitudinal and transverse strips of wood are secured in notches in the case corner wall junctures, the portions of the strips which project beyond the corner being thereafter removed, e.g., by sanding or the like to provide a smoothly rounded corner surface. U.S. Pat. No. 3,553,823 provides a transport container with special corner pieces comprised of interfitting crossing channel pieces which are welded together and then welded to the three container frame bars which meet at each trihedral-shaped corner of the container. U.S. Pat. No. 4,023,726 discloses a metal container construction in which a spherical corner closure cap is welded to the container wall structure adjacent a corner of the container to cover a corner opening. The closure cap is fitted at the inside of the container, the walls and cap being of companion fitting stepped arrangement so that the cap can more readily resist internal pressure within the container, an arrangement which deals with resistance to forces directly opposite to what is encountered when a container is impacted on the outside of the corner and wherein impact forces would tend to push such cap inwardly of the container.

It is therefore desirable that an improved blank erected container having a more effective corner closure be provided and that it be done so in a way as significantly increases the strength of the corner structure of such cases to resist impact forces which tend to dislodge the cap member inwardly into the container interior. As an adjunct, the corner closure should be such as to materially reduce the fabrication costs by eliminating the welded closure of the corner opening heretofore used.

SUMMARY OF THE INVENTION

The present invention is concerned with improvements in cases or containers of the type which are fabricated from a flat metal blank, the blank being scribed or otherwise marked to delineate plate segments representing the various ones of the side walls, bottom or top walls and convex dihedral transition pieces which join two adjacent perpendicularly disposed side walls to a bottom or top wall, the blank then being subjected to bending on a press brake to relatively angularly dispose the scribed segments in the form of a case structure, e.g., a parallelepiped or rectangularly configured housing that can constitute an upper or lower half part of a complete case enclosure. Prior to the bending operations, the blank can be punched to provide various openings therein in accordance with the requirements for later mounting of hinges, hasps, etc. to the case. In the blank at the juncture of three segments thereof which define two adjacent side walls and a top or bottom wall, the juncture region may be notched so that when the housing has been formed, the housing trihedron shaped corner formed by these three walls will have present an open corner, the opening being defined by correspondingly first end edge surfaces of the convex, i.e., parti-cylindrical transition pieces which join adjacent side walls with a bottom or top wall and an edge of a curved corner portion of the side walls. With the notch configuration used in the blank according to the invention, the prior recourse to sealing a corner opening with welding is eliminated in favor of a more effective yet more easily installed corner closure member. The opening will generally be of triangular curvilinear contour and the closure of the opening is effected in accordance with the invention such as to provide a watertight seal at the case corner and further, to provide a highly strengthened case corner structure which will resist damage or failure during both pre-use testing and the intended use purpose.

A cap member having a shape similar to the corner opening but being larger than the opening is received over such opening from the outside of the case and its size allows for an appreciable encircling overlap by the cap of the case walls and transition piece surfaces adjacent the opening. Preferably the cap member will be a segment of a hollow sphere so as to conformably intimately engage the case walls and transition pieces adjacent said corner opening. The cap member is fixedly secured to the case and for such purpose and where the cap member and case structure are compatible metal components, e.g., aluminum, the securement can be by a continuous weld extending around the perimeter of the corner opening from interiorly of the case and joining the cap to the case walls and transition piece inner surfaces. The cap member also can be fixedly secured to the case corner with a high strength bond adhesive such as an epoxy type, the adhesive being disposed intermediate the overlapping underface surface of the cap member and the case walls and transition piece exterior surfaces adjacent said corner opening. Since the cap member is securely fixed at the outside of the case corner, an enhanced strengthened case corner is provided which resists impact loadings that tend to force the cap through the corner opening into the case.

In another embodiment, the cap member may be grooved at the underface thereof in a course inwardly of the margins thereof and extending around the circumference or perimeter of the cap so as to define an underface triangular configured shoulder, the side edges of which follow curvilinear paths companion to the edge surfaces of the convex wall part first ends. When the cap is received over the corner opening, the shoulder will fit in the opening and the shoulder side edges will be in closely positioned confrontation with the convex wall part edge surfaces so that the cap shoulder will in effect constitute a continuation of the convergent wall transition piece structure at the case corner. The wider or outer part of the cap member will of course overlap the corner opening in the same manner as described above and will be fixedly secured in the same manner as described previously, i.e., welding interiorly of the container or adhesive connection at the outside.

The invention accordingly comprises the features of construction and arrangements of parts as embodied in the case corner construction as will be exemplified in the description hereinafter set forth and the scope of the invention will be indicated in the claims.

BRIEF DESCRIPTION OF THE DRAWINGS

A fuller understanding of the nature and objects of the invention will be had from the following detailed description taken in conjunction with the accompanying drawings, in which.

Throughout the following description like reference numerals are used to denote like parts in the drawings.

DESCRIPTION OF THE PREFERRED EMBODIMENTS

Figure 1:
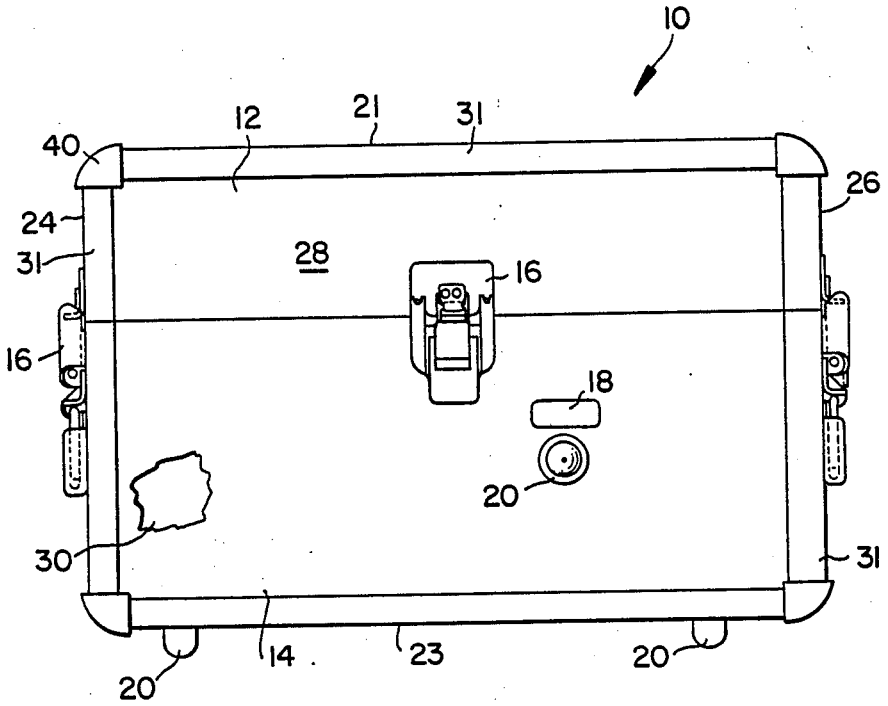
FIG. 1 is a front elevational view of a transit case the upper and lower container structure parts of which have been erected from flat metal blanks and open corners of such structure parts are provided with corner closure cap members secured thereto in accordance with the principles of the present invention.

Referring to FIG. 1, the depicted case 10 is a transit type case in which, e.g., electronic equipment such as part of the components of a portable radio station might be housed. The case is a lightweight structure made from aluminum and the interior thereof could be fitted with an equipment retaining cradle, padding etc. all as may be required for safeguarding and accommodating the equipment to be housed or carried therein. The case has a upper part 12 which can be hinged at the rear side (not shown) to lower part 14. It also will be provided with appurtenant devices such as hasps 16, identity label 18, relief valve 20 and support feet 22 all of which involve attachment through openings in the case wall structure and which openings advantageously are punched from flat blank stock from which the case structure is formed as will be discussed next.

Figure 10:
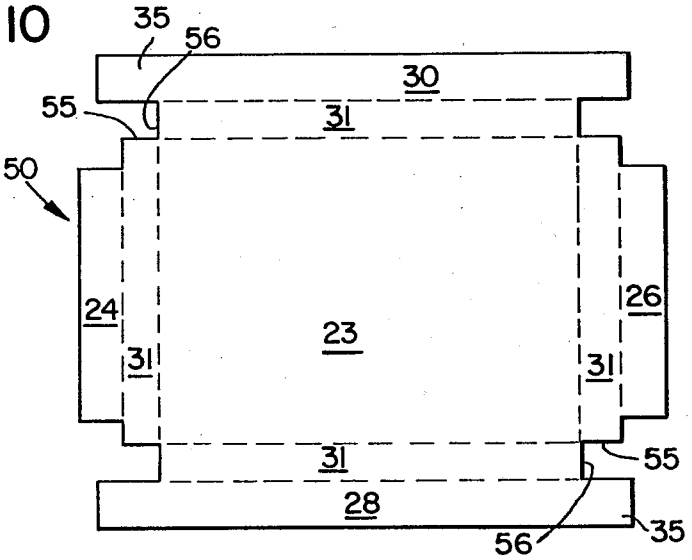
FIG. 10 is a flat aluminum blank from which a container structure can be erected by subjecting the blank to prescribed folding operations.
Figure 5:
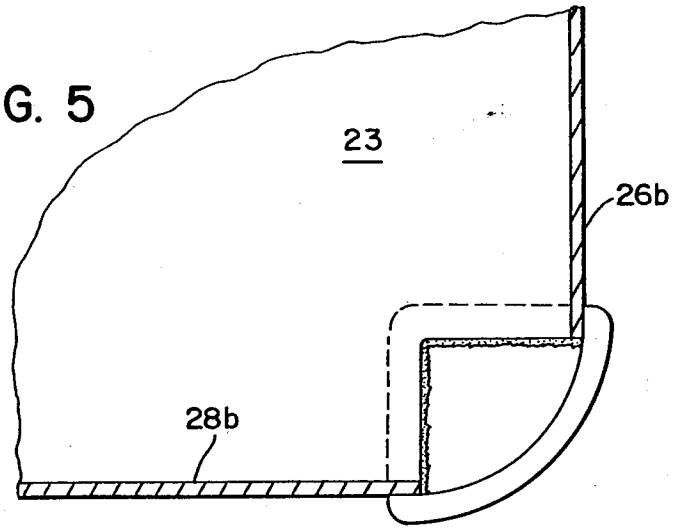
FIG. 5 is a fragmentary transverse sectional view of the FIG. 1 case bottom part showing the welded securement of the FIG. 2 cap member to the lower right front corner of the case.
Figure 9:
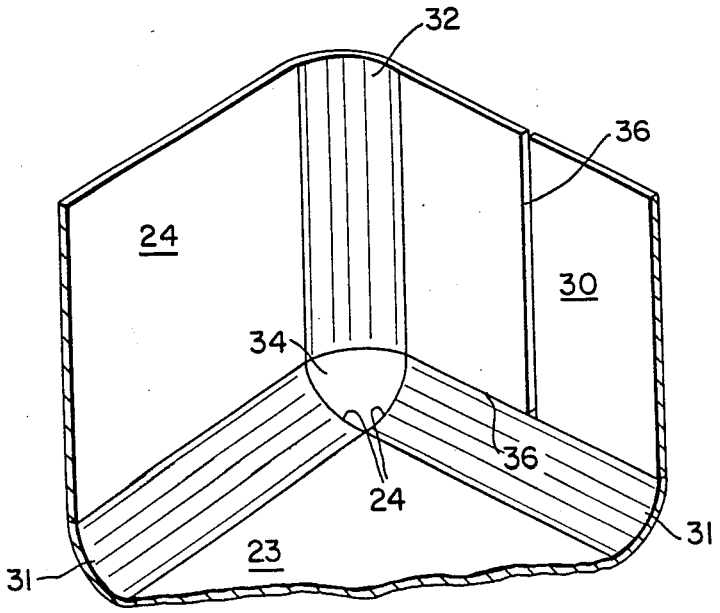
FIG. 9 is a view similar to FIG. 8 but showing how the corner is formed in accordance with the present invention so that such opening can be closed with a cap member.

The case parts 12 and 14 are formed from flat metal, e.g., aluminum sheet blank suitably scribed or otherwise marked into segments corresponding to side walls, top and bottom wall, etc. The blank, a representative one of which is shown in FIG. 10 and will be described in more detail later, is then subjected to bending in a press brake to relatively position the various segments to define the enclosure configured upper and lower parts and at certain locations, meeting wall structure will be welded along seams to form the respective rigidized upper and lower enclosure parts. This is a method for case construction which is to be distinguished from the method wherein a metal blank is formed into a container part in a deep draw formation. The case will have a top wall 21, a bottom wall 23, two end side walls 24, 26 and a front side wall 28 and rear side wall 30. The end walls and front and rear walls it will be understood each have parts associated into the case upper part 12 (designated, e.g., "28*a*") and parts associated with the case lower part (designated, e.g., "28*b*"). All of the walls desirably will be of planar character, and each side wall will be joined integrally to and perpendicularly disposed adjacent another by curved wall courses at the dihedral angle formed by the two side wall parts and the side walls in turn are also perpendicular to the top and bottom walls. Transition pieces 31 connect the top and bottom walls to the side walls, these elements being curved, preferably cylindrically shaped. Due to the folding procedure and the use of transition pieces 31, there will be left at each corner of the case parts a corner opening 34, such opening being defined by the corresponding one end edges 29 of the transition pieces 31 and a curved side wall course 32 which have the dihedral juncture as best seen in FIG. 9, the thus defined opening having a triangular, curvilinear contour as shown in that Figure.

Figure 2:
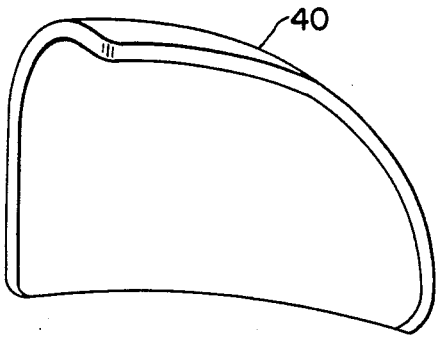
FIG. 2 is a perspective view of one form of the corner cap member provided by the present invention, as viewed from the inner side thereof.
Figure 3:
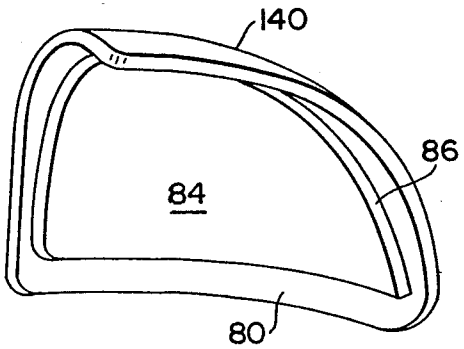
FIG. 3 is a perspective view similar to FIG. 2 of another form of corner cap member where the same is provided with a shoulder on the inner side thereof, the shoulder fitting a corner opening of the case when the cap member is secured in place.

Each corner opening 34 is closed off with a closure cap 40 (FIG. 2) the closure cap being shaped to follow the case structure contour at the corners thereof and in the depicted embodiment being a part of a hollow sphere and more particularly being one-eighth of such sphere. FIG. 3 shows another embodiment of cap member 140 which shall be described later. The closure cap will desirably therefore, have the three-sided, triangular curvilinear contour of the corner opening 34 only it will be of larger dimension than the opening so that it will appreciably overlap the corner opening when received exteriorly on the case corner in closure positioning. This overlap being at the exterior side of the case, provides an anchoring positioning of the cap member on the case to enhance case corner resistance to shock loading if the case is dropped or otherwise mishandled. This is to be contrasted with corner closure members received at the inside of the case corner, which closures can be "punched" inwardly when shock force is applied thereto.

Figure 4:
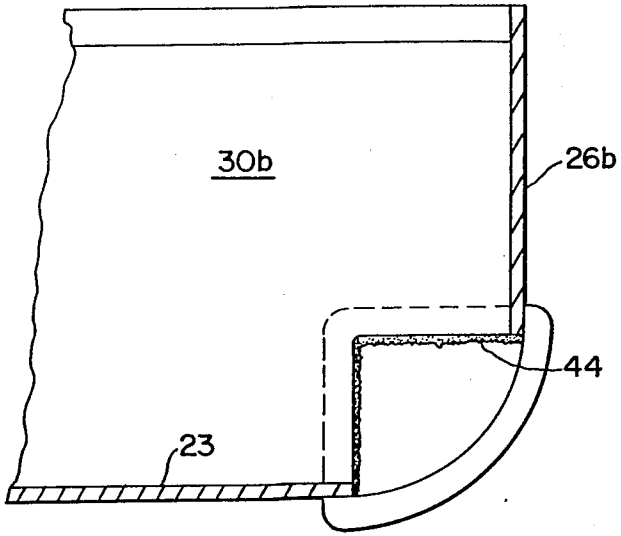
FIG. 4 is a fragmentary vertical sectional view of the FIG. 1 case bottom part showing the securement of the FIG. 2 cap member to the lower right rear corner of the case by means of welding.

The cap member is fixedly secured to the case corner in a manner as provides a watertight seal at the case corner. One manner of effecting this joinder is by an interior located continuous weld bead 44 (FIG. 4) extending around the periphery of the corner and joining same to adjacent wall and transition piece surfaces. This is effectively employed where the case and cap member are weld compatible materials, e.g., each being of aluminum. On the other hand and as shown in FIGS. 6 and 7, the cap member could be adhesively secured to the overlapped wall and transition piece surfaces with a layer 48 of an adhesive such as an epoxy type.

Figure 6:
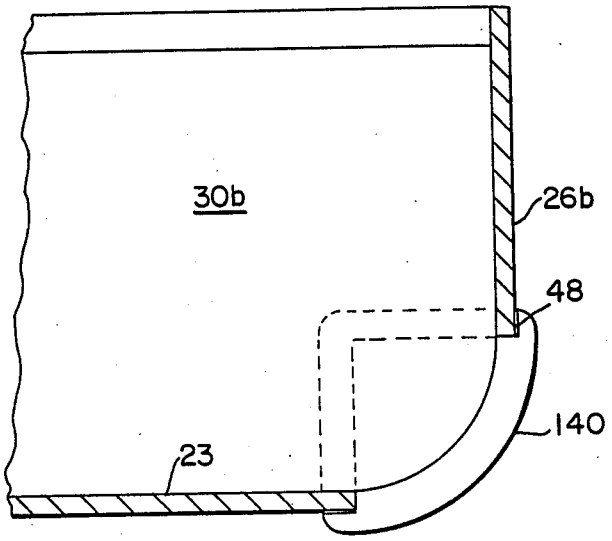
FIGS. 6 and 7 are the same as the respective FIGS. 4 and 5 depictions but show the manner of fixedly securing the FIG. 3 cap member adhesively to the case corners.
Figure 7:
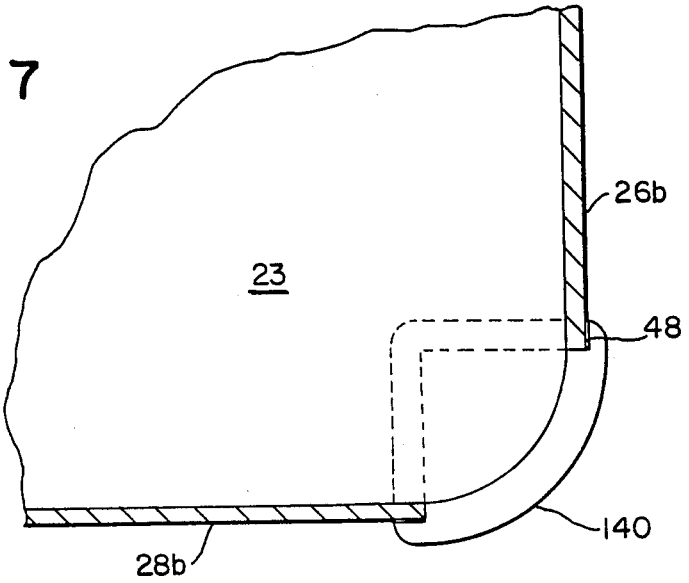

The cap member 140 shown in FIGS. 3, 6 and 7 is in plan profile configured like that shown in FIG. 3. It differs from cap 40 to the extent that it is thicker than cap 40 and the underface thereof is provided with a groove 80 extending inwardly from the side margins of the cap member and in a fully encircling course as most readily seen from FIG. 3. As a result, a shoulder 84 exists in the cap member and this shoulder has side edges 86 which follow the triangular curvilinear contour of the corner opening 34 and the shoulder thickness is substantially the same as that of said case wall parts and the convex wall transition pieces. Thus when this cap is received on a case corner, the shoulder 84 will seat in the case corner opening and its side edges 86 will be in closely positioned confrontation with the end edges 29 of the case corner opening defining structure. The fixing of the cap member 140 to the case corner will be either by welding interiorly or adhesive connection exteriorly as described above.

Figure 8:
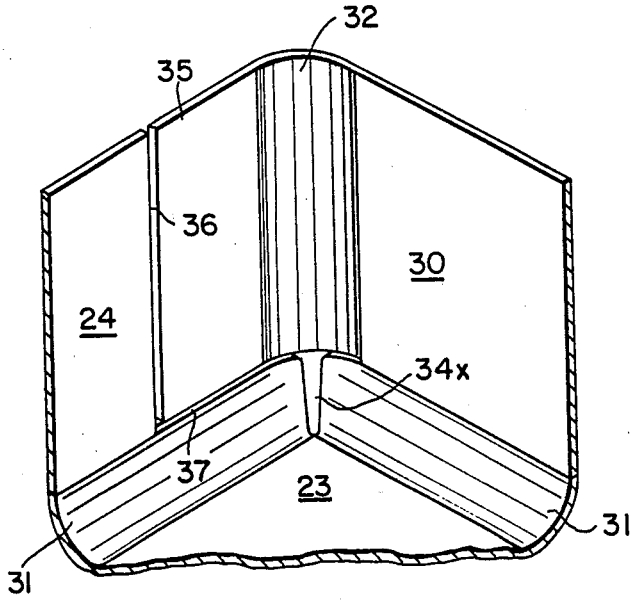
FIG. 8 is a fragmentary perspective of one corner region of a case bottom structure showing how the corner thereof was formed leaving a T-shaped opening that required closing by a welding filler.

As was indicated earlier, the present invention provides, inter alia, for an improved and more rugged corner construction for a case and does so by a construction that eliminates labor intensive practices heretofore involved in effecting corner closure seal in case fabrication wherein a case structure is formed from a flat metal blank and there inheres from such fabrication, formation of an opening in each corner of the structure. FIGS. 8 and 9 illustrate the differences between the prior and improved practices. With reference to FIG. 8, the corner of a flat blank erected case or a container of prior practice includes as defining structure, a flat bottom wall 23, the integral transition pieces 31 rolled in parti-cylindrical course and the respective ones of which present upstanding rear wall 30 and end wall 24. Rear wall 30 is longer than its associated transistion piece and end wall 24 is shorter so that a terminal end part 35 of the longer wall sweeps around the dihedral formed between walls 24 and 30 in a curved course 32 and a vertical end edge of wall 30 juxtaposes with a like end edge of wall 24 to define a seam spacing 36. A similar seam spacing 37 is found below terminal part 25 and an upper edge of the transition piece 31 associated with wall 24. These seams are filled with welding material to join the two adjacent walls. The corner opening 34X in this arrangement has a T-shape defined by the angulated end edges of the two transition pieces and the bottom edge of the curved courses 2 of wall 30. This T-shaped space also must be filled by welding. The removal of excess welding material involves much grinding and polishing at the outer side and particularly so because of the parti-spherical shape of the exterior corner surfaces. While the weld filler in the T-shaped space has great strength it is located right at the case corner and thus represents the point at which most times the impact forces are received when the case is dropped so that the consequence of such impacts may in many instances result in fracture of the corner joint.

FIG. 9 shows how the FIG. 8 structure is changed. The corner opening 34 in this structure is a relatively broad aperture and follows the triangular-curvilinear course depicted and defined on two sides by the rolled adjacent end edges of the transition pieces 31 which are located in planes at right angles to each other and to the margins of their associated sides of bottom wall 23, and on the third or top side by the lower edge of the curved course 32, of wall 24. The wall 24 in this depiction it will be noted has been made longer than wall 30. The same seam spacings 36 and 37 as seen in FIG. 8 are present in the FIG. 9 structure. The cap 40 is not shown in FIG. 9 but it can be seen that securement thereof to the corner readily can be effected by welding beads joining the cap inner surface to the transition piece end edges and the bottom edge of curved course 32. With this arrangement the brunt of any impact forces at the corner is on the cap member as such and not located at any joint. Further, use of the cap and interior side welding eliminates need to remove any weld material from the corner outer surfaces.

The sheet metal blank with which the FIG. 9 case construction is erected is shown in FIG. 10. The blank 50 includes an integral arrangement of segments that correspond to rectangular bottom wall 23, transition piece segment 31 at each of the opposed longitudinal and traverse margins of segment 23, opposed end wall segments 24, 26 and opposed side wall segments 28, 30. The terminal end parts 35 of segments 28, 30 are longer than their associated transition pieces and segments 24, 26 are shorter. The corner forming structure for each of the four corners of the case which can be erected from the blank, include the adjacent edge margins 55, 56 of the transition pieces and they are perpendicular to each other and the margins of segment 23. The curved corners 32 defined by the terminal parts of walls 28, 30 which are rolled to juxtapose the tip ends of said walls with the shorter end walls 24, 26.

While there is above described only certain embodiments of corner closure as provided by the invention, it will be understood that those skilled in the art may make various changes and modifications thereto while remaining within the scope of the inventive concept disclosed.

What is claimed is:

1. A rectangularly configured container structure with a reinforced corner, said structure including a first planar wall and a pair of adjacent planar walls perpendicular to each other and to said first wall, said adjacent walls being connected with the first wall by convex parti-cylindrical transition pieces integral with the first wall and the respective adjacent walls, the said first wall and pair of adjacent walls defining a case corner, one of said walls being longer and the other shorter than its associated transition piece whereby the longer wall extends in curved corner wraparound to termination thereof in edge-to-edge seam defining juxtapositioning with an end edge of the shorter wall and with a terminal edge part of the shorter wall associated transition piece, the said corner having a triangular curvilinear-shaped opening demarked by end edges of the adjacent walls transition pieces and a bottom edge of the curved course length of said one wall, a corner opening closure comprising a cap received positioned over said opening on the outer side of the corner, said cap having a shape expanse which is similar to but larger than said opening sufficiently to provide appreciable cap encircling overlap of the said first and adjacent walls and transition pieces situate adjacent said opening, said cap being configured to conformably engage against the outer surfaces of said first and adjacent walls and transition pieces where same are overlapped, and means fixedly securing said cap to the container in the said received position.

2. The container structure of claim 1 in which the securing means comprises an adhesive layer intervening the overlapping portions of the cap and the outer surfaces of the first and adjacent walls and transition pieces where overlapped by said cap.

3. The container structure of claim 2 in which the adhesive is an epoxy type.

4. The container structure of claim 1 in which the first and adjacent walls, transition pieces and cap are metal components, the securing means comprising a weld deposit encircling the perimeter of said corner opening at the interior side thereof and joining said cap to adjacent portions of said first and adjacent walls and said transition pieces.

5. The container structure of claim 4 in which the first and adjacent walls, transition pieces and the cap are aluminum.

6. The container structure of claim 1 in which the cap is grooved at the underface thereof in a course inwardly of its margins and extending around the cap periphery to define an underface triangular configured cap shoulder, the side edges of which follow curvilinear paths companion to the transition piece end edge surfaces and said one wall bottom edge curved course length so that when the cap is received over said corner opening the said end and bottom edge surfaces and the cap side edges are in closely positioned confrontation with each other.

7. The container structure of claim 6 in which the thicknesses of the first and adjacent walls and transition piece is substantially equal and the cap shoulder has a like thickness.

8. A method for making a rectangular configured container structure with reinforced corners which comprises forming a flat metal sheet blank having an integral arrangement of segments therein corresponding to a container first rectangular wall, transition pieces at the opposed longitudinal and transverse margins of the first wall segment, and opposed pairs of wall members extending from the transition piece segments, one pair of said opposed wall member segments being longer and the other pair shorter than their associated transition pieces, rolling each of the transition piece segments upwardly from the first wall segment margins into a convex parti-cylindrical configuration to thereby dispose said wall member segments perpendicular one to adjacent ones and to said first wall and define corners where adjacent wall members and said first wall intersect, the end edges of the transition pieces being arranged in the blank such as to be perpendicular to the margin of the first wall segment and the larger wall member segments being arranged such that where they extend beyond their associated transition pieces they present longer wall lower edges parallel to an associated first wall margin, rolling terminal end portions of the longer wall members in a curved course at the container corners to juxtapose an end edge thereof and an end edge of a shorter wall member as well as an upper edge part of a shorter wall transition piece and a longer wall lower edge in seam defining spacing, the end edges of adjacent rolled transition pieces and a curved course part lower edge of a longer wall member together defining a triangular curvilinear-shaped corner opening, joining the wall members and transition pieces by welding with the welding deposit filling the seam defining spacings, providing corner cap members shaped to fit over the corner openings and conformably engage the outer surfaces of the first wall and in an appreciable overlap expanse of the adjacent wall members and the transition pieces adjacent the respective openings, and fixedly securing said cap members to said outer surfaces.

9. The method of claim 8 in which the cap members are fixedly secured by welding them with a weld deposit interiorly of the corner extending around the perimeter of the corner opening and joining the cap with adjacent portions of the first wall, adjacent wall members and transition pieces.

10. The method of claim 8 in which the flat metal sheet blank is aluminum having a thickness of substantially 0.09 inches

* * * * *